US005207257A

United States Patent [19]

Rupel et al.

[11] Patent Number: 5,207,257

[45] Date of Patent: May 4, 1993

[54] ADJUSTABLE EXPANDABLE AND COLLAPSIBLE SHADE

[75] Inventors: John D. Rupel, Verona; Judy M. Bergman, Madison, both of Wis.

[73] Assignee: Springs Window Fashions Division, Inc., Middleton, Wis.

[21] Appl. No.: 951,151

[22] Filed: Sep. 25, 1992

[51] Int. Cl.[5] ..... E06B 9/06

[52] U.S. Cl. ..... 160/84.1; 160/134

[58] Field of Search ..... 160/84.1, 134, 330, 160/348

[56] References Cited

U.S. PATENT DOCUMENTS

| | | | |
|---|---|---|---|
| 451,068 | 4/1891 | Park | 160/134 X |
| 4,450,027 | 5/1984 | Colson . | |
| 4,739,815 | 4/1988 | Altman . | |
| 4,753,281 | 6/1988 | Wagner . | |
| 4,846,243 | 7/1989 | Schneider . | |
| 4,858,669 | 8/1989 | Vinson | 160/84.1 X |
| 4,861,404 | 8/1989 | Neff . | |
| 4,934,436 | 6/1990 | Schnebly | 160/84.1 |
| 5,002,112 | 3/1991 | Schnebly et al. | 160/84.1 |
| 5,015,317 | 5/1991 | Corey et al. . | |
| 5,139,070 | 8/1992 | Kidd | 160/84.1 |

*Primary Examiner*—Blair M. Johnson
*Attorney, Agent, or Firm*—Vernon J. Pillote

[57] ABSTRACT

An adjustable shade comprising an upper headrail and a lower rail and a transversely pleated expandable and collapsible shade member attached to the upper headrail and to lower rail and extending therebetween. The lower rail means including two lower rail sections and a hinge device that interconnect the lower rail sections for swinging movement between a position in which the lower rail sections extend in relatively opposite directions parallel of the upper headrail and a position in which the lower rail sections extend downwardly from the hinge. One lift cord is attached to the hinge device and extends upwardly through the first row of cord guide openings to the upper headrail, and a first shade operating means connected to the first lift cord means for raising the proximate ends of the lower rail sections while allowing distal ends of the lower rail sections to swing downwardly and draw lower portions of the pleated shade member into an inverted fan configuration. Second and third lift cords are attached to respective ones of the lower rail sections at locations spaced from the hinge device and extends upwardly to the upper headrail, and a second shade operating means is connected to the second and third lift cords for raising the lower rail sections in parallel relation to the upper headrail.

13 Claims, 2 Drawing Sheets

ADJUSTABLE EXPANDABLE AND COLLAPSIBLE SHADE

BACKGROUND OF THE INVENTION

The present invention relates to adjustable expandable and collapsible window shades of the type having a headrail and a lower rail and lift cords for raising and lowering the lower rail. The pleated expandable and collapsible shade material is arranged to collapse along predetermined fold or crease lines into a compact stack to uncover a window opening when the lower rail is raised and to expand as the lower rail is lowered to wholly or partially cover the window opening. In the prior adjustable window shades of this type known to the applicants, the lower rail and lift cords for raising and lowering the lower rail operate in a manner to maintain the lower rail generally horizontal during movement between raised and lowered positions.

SUMMARY OF THE INVENTION

It is the general object of this invention to provide an adjustable shade having transversely pleated expandable and collapsible shade material in which the shade can conform to a rectangular opening when closed, and in which the lower portion of the shade can be formed into a decorative inverted fan configuration when the shade is operated to a partially or fully raised position.

A further object of this invention is to provide an adjustable shade having transversely pleated expandable and collapsible shade material in which the shade can be selectively operated in one mode in which the lower rail remains parallel to the pleats when the shade is raised, or in a second mode in which the lower end portion of the shade is formed into a decorative inverted fan configuration when the shade is raised.

Accordingly, the present invention provides an adjustable shade comprising upper headrail means and lower rail means and a transversely pleated expandable and collapsible shade member attached to the upper headrail means and to the lower rail means. The lower rail means includes two stiff lower rail sections, and means interconnecting the lower rail sections for relative movement between a position in which the lower rail sections extend in opposite directions generally parallel to the headrail means and a position in which the lower rail sections extend downwardly from the interconnecting means. A first lift cord means is attached to the interconnecting means and extends upwardly through a row of cord guide openings to the upper headrail means and a first shade operating means is connected to the first lift cord means for raising the proximate ends of the lower rail sections while allowing the distal ends of the lower rail sections to swing downwardly and draw lower portions of the pleated shade member into an inverted fan configuration.

The adjustable shade also advantageously includes second and third lift cord means attached to respective ones of the lower rail sections at locations spaced from the interconnecting means and extending upwardly to the upper headrail means, and second shade operating means connected to the second and third lift cord means for raising the lower rail sections while in parallel relation to the upper headrail means.

Figure 1:
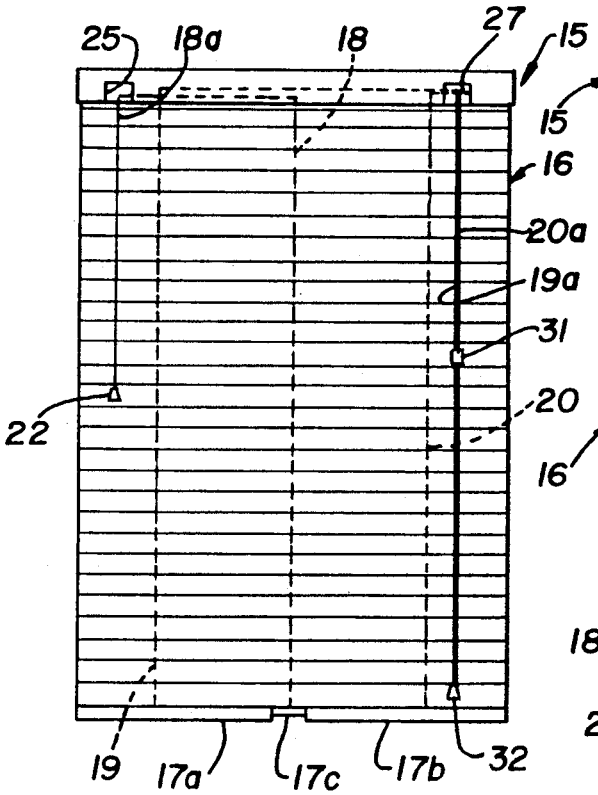
FIG. 1 is a schematic front view of an adjustable shade embodying the present invention and showing the shade in a fully lowered position to cover a rectangular window opening.

The adjustable shade of the present invention in general includes a headrail means 15, a pleated expandable and collapsible type shade member 16, a lower rail means 17 having first and second rail sections **17*a* and 17*b*, and a first lift cord means 18 for raising the shade in a fan mode and a second lift cord means 19, 20** for raising the shade in a rectilinear mode.

As used herein, the pleated expandable and collapsible shade member includes a shade or curtain which is pleated or folded transversely of its length so that it can be expanded to cover a window opening and collapsed into a compact stack. The pleated and expandable and collapsible shade member may, for example, comprise a single web member accordion folded crosswise of its length such as illustrated in U.S. Pat. No. 4,753,281; honeycomb type shade materials having cells extending transverse to the width of the shade member such as shown in U.S. Pat. Nos. 4,450,027 and 4,861,404; multicell shade material such as disclosed in U.S. Pat. No. 5,015,317; and shade material formed with interconnected transverse pockets such as disclosed in U.S. Pat. No. 4,846,243.

Figure 2:
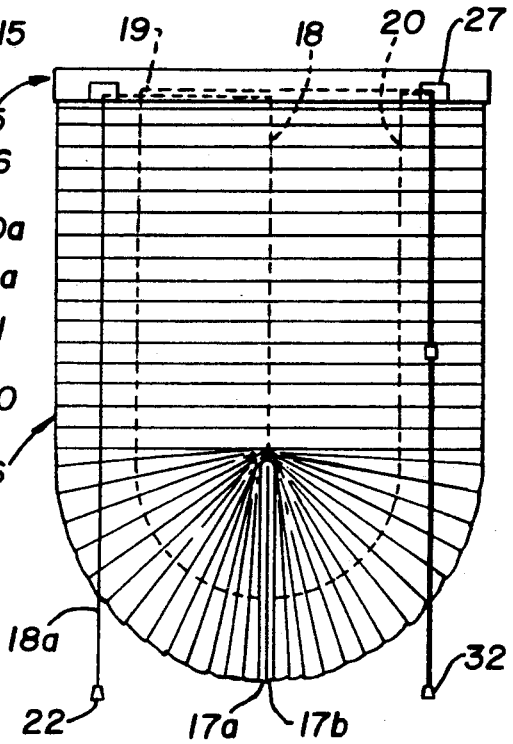
FIG. 2 is a schematic front view illustrating the adjustable shade of FIG. 1 operated in a fan mode drawing a lower portion of the shade into an inverted fan configuration.
Figure 3:
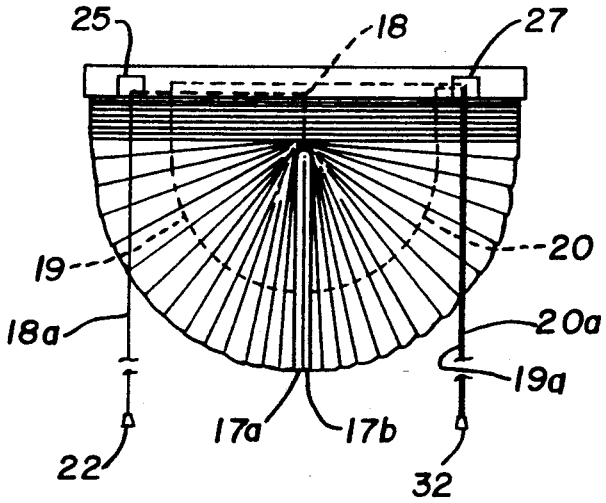
FIG. 3 is a schematic front view illustrating the shade of FIG. 2 in a fully raised position.

The shade member 16 has a generally rectangular configuration and a length to cover a window opening when the lower rail means is in a fully lowered position as shown in FIG. 1. The upper end portion of the shade member is attached to the headrail 15 in a manner to be supported thereby with the folded pleats extending generally parallel to the headrail and the lower portion of the shade member is attached to the rail sections **17*a* and 17*b*, with the rail sections extending generally parallel to the folds or creases in the shade member. The lower rail sections 17*a* and 17*b* are sufficiently stiff to normally retain a straight configuration and each have a width approximately one-half the width of the shade member. The lower portion of the shade member is attached to the lower rail section with one-half the lower portion of the shade being attached to the rail section 17***a* for movement therewith and the other half of the lower portion of the shade member attached to the rail section 17*b* for movement therewith. The shade is attached to the lower rail sections with the proximate ends of the rail sections disposed approximately midway between side edges of the shade member and with the rail sections extending generally parallel to the pleats or folds in the shade member. The lower rail sections are interconnected by a means indicated generally at 17*c* for relative movement between an aligned position in which the lower rail sections extend in opposite directions from the proximate ends thereof as shown in FIG. 1, and a depending position in which the lower rail sections extend downwardly from the proximate ends thereof in sidewise adjacent relation as shown in FIGS. 2 and 3. The interconnecting means may, for example, comprise a flexible type hinge member formed of a flexible material having end portions anchored to the proximate ends of the rail sections and an intermediate portion extending between the rail sections and which is sufficiently thin to allow the rail sections to swing from an aligned position to a depending position under their own weight. If the rail sections themselves are not sufficiently heavy to gravitationally swing to a depending position, suitable weights can be applied to the rail sections.

It is also contemplated that the rail sections could be swingably interconnected by a mechanical type hinge with a pivot axis or axes disposed generally transverse to the plane of the shade member when the latter is in its expanded condition. Further, as described more fully hereinafter, in some types of shades members, the portion of the shade member that is disposed between the proximate ends of the lower rail sections can also function to swingably interconnect the rail sections.

The first lift cord means 18, hereinafter sometimes referred to as a center lift cord means, is connected to the lower rail means adjacent the proximate ends of the lower rail sections for raising the proximate ends of the lower rail sections while allowing the distal ends of the lower rail sections to swing downwardly. The lift cord means 18 is attached to the interconnecting means 17*c* or to the lower portion of the shade member adjacent the proximate ends of the rail members. Alternatively, it is contemplated that center lift cord could be attached directly to the lower rail sections adjacent their proximate ends.

The lift cord means 18 is arranged to extend through a first or center row of cord guide openings (not shown) located in the shade member intermediate the front and rear faces thereof, to the upper headrail 15. As shown in FIGS. 1 and 2, lift cord means 18 passes into the headrail through a suitable opening or guide (not shown) and extends lengthwise of the headrail and then downwardly through a cord guide and lock mechanism 25 and terminates in a depending operating portion 18*a* having a tassel 22. When the operating portion 18*a* is pulled downwardly, the lift cord 18 raises the proximate ends of the lower rail sections while allowing the distal ends of the lower rail sections to swing downwardly. During initial upward movement of the center lift cord 18, the lower rail sections swing downwardly in relatively diverging relation and the angle between the lower rail sections decreases as the lift cord 18 is raised until the rail sections are disposed in side-by-side relation as shown in FIG. 2 when the lift cord 18 is raised a distance only slightly greater than one-half the width of the shade. Lift cord 18 can be operated to raise the shade to a further or fully opened position for example as shown in FIG. 3, while maintaining the inverted fan configuration at the lower portion of the shade. In order to reduce or minimize the likelihood of a light gap between the depending rail sections 17*a* and 17*b* in the fan configuration, a means diagrammatically indicated at 28*a* and 28*b* in FIGS. 9–12, are advantageously provided for releasably retaining the lower rail sections in side-by-side relation. This means preferably comprises a magnet on one of the rail sections and magnetic material on the other of the rail sections. It is also contemplated that other releasable retaining means such as loop and hook type fastening means could also be used.

Figure 4:
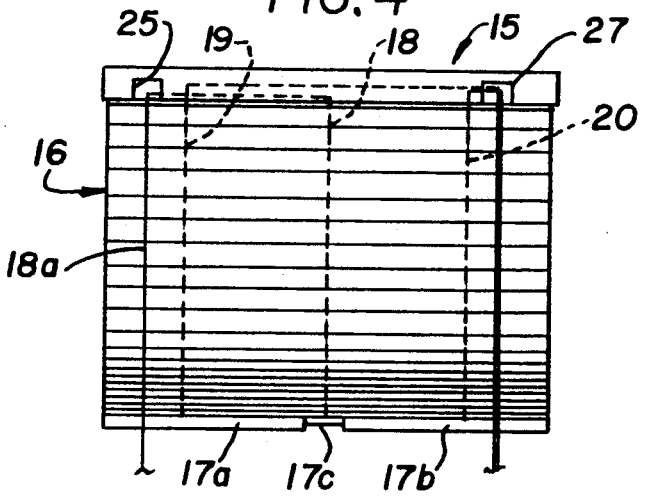
FIG. 4 is a schematic front view of the shade of FIG. 1 illustrating the shade operated in a rectilinear mode to a partially raised position.

The adjustable shade is also arranged for operation in a rectilinear mode in which the lower rail means is raised and lowered with the rail sections 17*a* and 17*b* substantially aligned. For this purpose, the second and third lift cord means 19 and 20 are attached to the rail sections 17*a* and 17*b* at locations spaced from the proximate ends of the rail section. The second lift cord means 19 and the third lift cord means 20 can each comprise a single lift cord attached to the respective rail sections 17*a* and 17*b* at locations approximately medially between the ends of the respective rail section. Alternatively, the second and third lift cord means can each comprise two or more lift cords attached to the respective rail sections at locations spaced apart along the respective rail sections. The lift cords 19 and 20 extend upward through cord guide openings (not shown) formed in the shade material, to the upper headrail means 15. The lift cords 18 and 19 extend through openings or cord guides into the headrail and longitudinaly of the headrail and through a cord guide and lock 27 and terminate in downwardly extending operating portions 19*a* and 20*a*. A cord equalizer 31 is applied to the depending operating portions 19*a* and 20*a* to equalize movement of the operating portions and the operating portions terminate in a cord tassle 32. When the operating portions 19*a* and 20*a* of the lift cords are pulled downwardly, the lower rail sections are raised equally and remain in an aligned condition generally parallel to the headrail as shown in FIG. 4. When the lower portion of the shade is in the fan configuration as shown in 2 and 3, the lift cords 19 and 20 extend in an arc through the fan portion and, if the lift cords 19 and 20 are pulled upwardly in this configuration, they will tend to draw the lower portion of the shade back to a straight condition.

Figure 5:
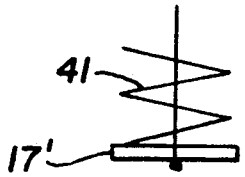
FIG. 5 is a schematic partial end view illustrating the invention applied to an accordion folded type expandable and collapsible shade member.
Figure 6:
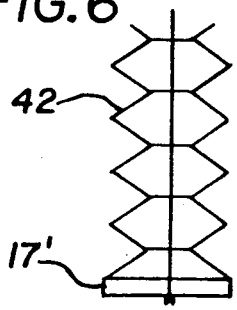
FIG. 6 is a schematic partial end view illustrating the invention applied to a honeycomb type expandable and collapsible shade member.
Figure 9:
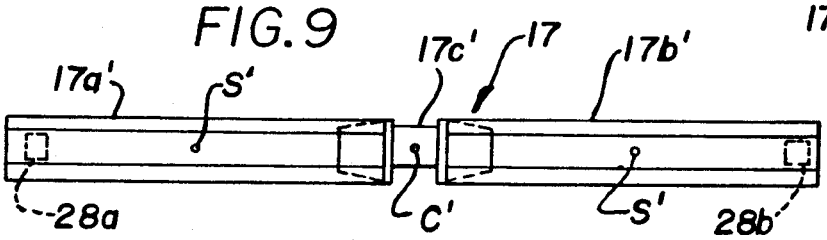
FIG. 9 is a top view of a lower rail means suitable for expandable and collapsible shades of the type shown in FIGS. 5–7.
Figure 7:
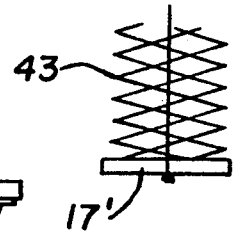
FIG. 7 is a schematic partial end view illustrating the invention applied to a multi-cellular type expandable and collapsible shade member.
Figure 10:
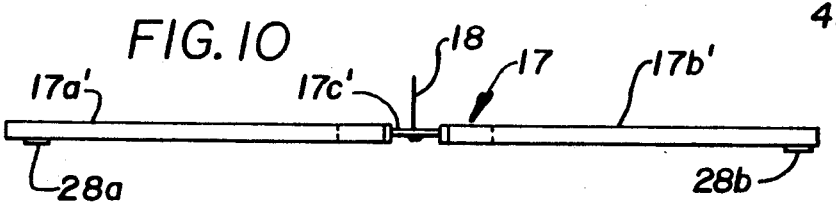
FIG. 10 is a side view of the lower rail means of FIG. 9.
Figure 8:
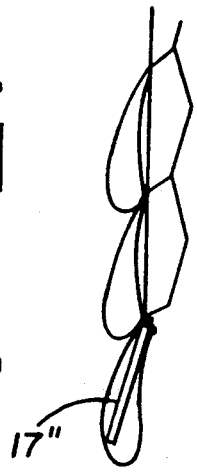
FIG. 8 is a schematic partial end view illustrating the invention applied to a pocket type expandable and collapsible shade member.
Figure 11:
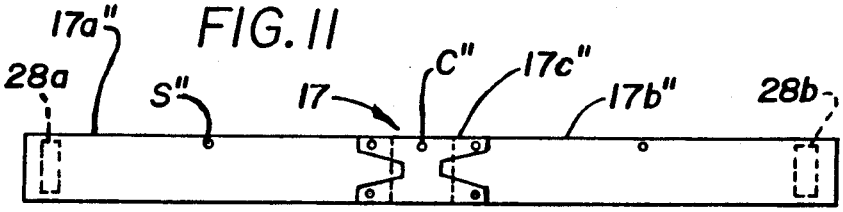
FIG. 11 is a top view of a bottom rail suitable for expandable and collapsible shades of the type shown in FIG. 8.
Figure 12:
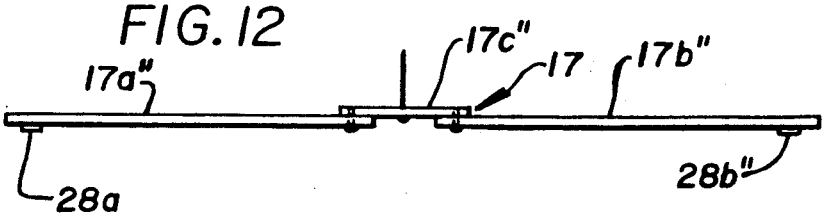
FIG. 12 is a side view of the lower rail means of FIG. 11.

The invention is schematically shown in FIG. 5 applied to an accordion type shade material 41; in FIG. 6 to a honeycomb cell type shade material 42; in FIG. 7 to a multi-cell type shade material 43; and in FIG. 8 to a pocketed type expandable and contractable shade material. FIGS. 9 and 10 illustrate a bottom rail means suitable for use with the shade material shown in FIGS. 5–7 in which the lift cord openings are disposed approximately midway between opposite sides of the shade material. The bottom rail sections designated 17*a*′ and 17*b*′ are interconnected by a flexible member or hinge 17*c*′. The central lift cord means 18 is preferably secured to the interconnecting means 17*c*′ at a location designated C′ and the side lift cords 19 and 20 connected to the rail sections 17*a*′ and 17*b*′ at locations designated S1 preferably medially between the side edges of the rail sections as shown in FIG. 9. In the embodiment of FIG. 8, the invention is schematically shown applied to an expandable and collapsible shade of the type having loops or pockets at the front side of the shade member interconnected by a spacer web at the rear. In this embodiment, the lower rail sections designated 17*a*" and 17*b*" are inserted into a lower pocket of the shade member with the proximate ends of the lower rail sections adjacent the center of the shade material. A flexible means 17C" is provided for interconnecting the rail sections 17*a*" and 17*b*". However, it has also been found that the portion of the lower pocket into which the rail sections are inserted can function to flexibly interconnect the rail sections. In this embodiment, the center lift cord is attached to the interconnecting means 17*c*" or to the fabric of the lower pocket adjacent the proximate ends of the lower rail section. In the pocket type expansible and collapsible shade material shown in FIG. 8, the lift cord openings are disposed adjacent the upper edges of the pockets and the lift cord 18 is accordingly attached to the interconnecting means at C" or to lower pocket adjacent its upper edge. Similarly, the side lift cords 19 and 20 are attached to the lower rail sections at locations S" intermediate their ends and preferably adjacent the upper edge as shown in 11.

From the foregoing it is believed that the construction and operation of the adjustable shade will be readily apparent. The pleated expansible and contractable shade material 16 has a rectangular configuration and a length to cover the window opening when the lower rail means 17 is in its lowered position. The lift cord 18 and operating means 18*a* is arranged to operate the shade in a first or fan mode in which the proximate ends of the lower rail means are lifted while the distal ends are allowed to swing downwardly to form the lower portion of the shade into an inverted fan configuration. The lift cord means 19 and 20 operate the shade in a second or rectilinear mode in which the lower rail sections are lifted equally so that the bottom of the shade remains generally parallel to the pleats during raising of the shade, as shown in FIG. 4.

The embodiments of the invention in which an exclusive property or privilege is claimed are defined as follows:

1. An adjustable shade comprising: upper headrail means and lower rail means and a transversely pleated expandable and collapsible shade member, means attaching an upper portion of the shade member of the upper headrail means, the lower rail means including two stiff lower rail sections, means attaching a lower portion of the shade member to the lower rail sections with the rail sections having proximate ends disposed approximately midway between side edges of the shade member, means interconnecting the lower rail sections for relative movement between a position in which the lower rail sections extend in opposite directions from the proximate ends thereof generally parallel to the upper headrail means and a position in which the lower rail sections extend downwardly from the proximate ends thereof, the shade member having a first row of aligned cord guide openings therein, first lift cord means attached to the interconnecting means and extending upwardly through the first row of cord guide openings to the upper headrail means, and first shade operating means connected to the first lift cord means for raising the proximate ends of the lower rail sections while allowing distal ends of the lower rail sections to swing downwardly and draw lower portions of the pleated shade member into an inverted fan configuration.

2. An adjustable shade according to claim 1 wherein said interconnecting means is constructed and arranged so that the lower rail sections can swing downwardly into sidewise adjacent relation.

3. An adjustable shade according to claim 1 including second and third lift cord means attached to respective ones of the lower rail sections at locations spaced from the interconnecting means and extending upwardly to the upper headrail means, and second shade operating means connected to the second and third lift cord means for raising the lower rail sections in parallel relation to the upper headrail means.

4. An adjustable shade according to claim 3 when the second and third lift cord means are attached medially between the ends of the respective lower rail sections.

5. An adjustable shade according to claim 1 wherein the shade member has second and third rows of aligned openings spaced from the first row of openings, second and third lift cord means attached to respective ones of the lower rail sections at locations spaced from the interconnecting means and extending upwardly through the second and third rows of openings to the upper headrail means, and second shade operating means connected to the second and third lift cord means for raising the lower rail sections.

6. An adjustable shade according to claim 5 wherein the interconnecting means is constructed and arranged so that the lower rail sections can swing downwardly into sidewise adjacent relation.

7. An adjustable shade according to claim 6 including means for releasably retaining the lower rail sections in said sidewise adjacent relation.

8. An adjustable shade comprising: upper headrail means and lower rail means and a transversely pleated shade member, means attaching an upper portion of the shade member to the upper headrail means, the lower rail means including two lower rail sections, means attaching a lower portion of the shade member to the lower rail sections with the said sections having proximate ends disposed approximately midway between side edges of the shade member, and means interconnecting proximate ends of the lower rail sections for swinging movement between a position in which the rail sections extend generally parallel to the lower headrail means and a position in which the rail sections extend downwardly in sidewise adjacent relation, the shade member having a center row of aligned cord openings and at least two side rows of aligned openings spaced from relatively opposite sides of the center row, a center lift cord attached to the interconnecting means and extending upwardly through the center row of cord guide openings to the upper headrail means, at least two side lift cords each attached to a respective one of the lower rail sections at locations spaced from the interconnecting means and extending upwardly through a respective one of the side rows of openings to the upper headrail means, a first shade operating means connected to the center lift cord for raising the proximate ends of lower rail sections while allowing distal ends of the lower rail sections to swing downwardly into sidewise adjacent relation and draw the lower portion of the pleated shade member into an inverted fan configuration, and second shade operating means connected to the side lift cord means for raising the pair of lower rail sections.

9. An adjustable shade according to claim 8 including means for releasably retaining the lower rail sections in said sidewise adjacent relation.

10. An adjustable shade comprising: upper headrail means and lower rail means and a transversely pleated expandable and collapsible shade member attached to the upper headrail means and to the lower rail means and extending therebetween, the lower rail means including two stiff lower rail sections and means interconnecting the lower rail sections for swinging movement between a position in which the lower rail sections extend in relatively opposite directions from the interconnecting means parallel of the upper headrail means and a position in which the lower rail sections extend downwardly from the interconnecting means, the shade member having a first row of aligned cord guide openings therein, first lift cord means attached to interconnecting means and extending upwardly through the first row of cord guide openings to the upper headrail means, and first shade operating means connected to the first lift cord means for raising the interconnecting means while allowing distal ends of the lower rail sections to swing downwardly and draw lower portions of the pleated shade member into an inverted fan configuration.

11. An adjustable shade according to claim 10 including second and third lift cord means attached to respective ones of the lower rail sections at locations spaced from the interconnecting means and extending upwardly to the upper headrail means, and second shade operating means connected to the second and third lift cord means for raising the lower rail sections while maintaining the latter generally in parallel relation to the upper headrail means.

12. An adjustable shade according to claim 10 wherein the interconnecting means is constructed and arranged so that the lower rail sections can swing downwardly into sidewise adjacent relation.

13. An adjustable shade according to claim 12 including means for releasable retaining the lower rail sections in said sidewise adjacent relation.

* * * * *

UNITED STATES PATENT AND TRADEMARK OFFICE

CERTIFICATE OF CORRECTION

PATENT NO. : 5,207,257

DATED : May 4, 1993

INVENTOR(S) : John D. Rupel, Judy M. Bergman

It is certified that error appears in the above-identified patent and that said Letters Patent is hereby corrected as shown below:

Item [75]

On title page, change name of co-inventor from "Judy M. Bergman" to -- Judy M. Bergeman --;

Claim 1, column 5, line 48, change "of", second occurrence, to -- to --.

Signed and Sealed this

Thirtieth Day of November, 1993

Bruce Lehman

*Attest:*

BRUCE LEHMAN

*Attesting Officer*

*Commissioner of Patents and Trademarks*